United States Patent [19]

Lopes

[11] Patent Number: 5,003,280

[45] Date of Patent: Mar. 26, 1991

[54] LEAD-SUPPORTING FUSE AND CIRCUIT INCLUDING SUCH A FUSE

[76] Inventor: Rosario Lopes, 19266 Berden, Harper Woods, Mich. 48225

[21] Appl. No.: 484,672

[22] Filed: Feb. 26, 1990

[51] Int. Cl.[5] ..... H01H 85/02; H01H 85/50

[52] U.S. Cl. ..... 337/199; 337/214; 439/621

[58] Field of Search ..... 337/199, 206, 214, 215; 439/621, 622

[56] References Cited

U.S. PATENT DOCUMENTS 2,315,311 3/1943 Brown .
2,586,171 2/1952 McMahon .
2,916,587 12/1959 Bernstein .
3,187,146 6/1965 Schrader .

*Primary Examiner*—H. Broome
*Attorney, Agent, or Firm*—Gifford, Groh, Sprinkle, Patmore and Anderson

[57] ABSTRACT

An automotive fuse includes a pair of spring clips connected by a fusible bridge and a transparent shield extending laterally over the width of at least the bridge and a face of one of the clips. The shield is connected to only one of the clips, so that the other clip and any associated lead fall freely from the fuse when the bridge fuses in response to excessive current. The clips are adapted for engagement with matching clips on hot or utility leads in the circuits to which the fuses are connected. The shield can be tinted with color to correspond to the amperage rating of the fuse.

12 Claims, 1 Drawing Sheet

LEAD-SUPPORTING FUSE AND CIRCUIT INCLUDING SUCH A FUSE

BACKGROUND OF THE INVENTION

I. Field of the Invention

The present invention relates to devices for preventing excessive voltage or current from damaging components in an electrical circuit, and more particularly, to fuses for domestic and especially automotive circuits.

II. Description of the Prior Art

Fuses are well-known devices for preventing excessive current from damaging electrical circuits and components in electrical circuits. In its simplest form a fuse consists of a piece of wire of controlled dimension and composition which is placed across a gap in a circuit. The fuse wire is intended to melt when the current through it reaches a predetermined value. The wire is chosen to suit the maximum current which the circuit and components can tolerate without damage. When the wire is subjected to such a current, the beat developed in it can no longer be dissipated quickly enough, and the wire melts. Once the wire has melted, current does not flow through the gap the wire once filled, and the circuit is effectively broken.

Several types of fuses and circuit breaking devices are known, but the use of each in relatively delicate but mass-produced circuitry (such as the type commonly employed in automobiles) has been subject to some drawbacks.

Simple rewireable fuses, that is, simple lengths of wire threaded between fuse terminals, are cumbersome because replacement after melting may be hampered by melted metal from the fuse wire which has adhered to the fuse terminals. Moreover, there exists the possibility of direct shorting, across the exposed terminals to which the fuse wire was connected, by some other wire or object.

Cartridge fuses comprise a hollow glass body containing a fuse wire, whose ends are connected to metal caps forming the fuse terminals. Although relatively inexpensive, such fuses are still more costly to manufacture and install than rewireable fuses. Moreover, the potential still exists for inadvertant shorting across the exposed fuse terminals or across the clips conventionally employed to connect these cartridge fuses to the circuit in which they are placed. Cartridge fuses of the type incorporating a plurality of narrow segments in the fusible elements, or which surround the element with a friable insulating powder, are of course more expensive to produce.

Electromechanical circuit breakers provide more certain breaking of the circuit, as do spring-biased, expulsion-type fuse links. Such devices, however, are even more expensive to manufacture than cartridge fuses, and take up more space when used. The limited space usually available and typically employed for installing fuses in locations such as in automobiles may not adequately accommodate the number of fuses necessary for the number of circuits present.

SUMMARY OF THE PRESENT INVENTION

The present invention overcomes these and other problems by providing a very inexpensive and simple fuse construction which can be advantageously employed in gang power supply circuits (such as those in automotive applications) without requiring repositioning of the fuse box from the location conventionally used. The fuse of the present invention is intended for use in providing a fusible connection between first and second circuit elements.

The fuse of the present invention first comprises a fusible element having a fusible center portion, a first connecting means for connecting the first circuit element to the fusible center portion, and a second connecting means for connecting the second circuit element to the fusible center portion. The fusible center portion and the first and second connecting means are of a unitary and one piece construction, continuously composed from a fusible material.

The fuse of the present invention also comprises a shield means extending laterally over the width of the fusible center portion and at least part of (and preferably over the entire width of) at least one of the first and second connecting means. The shield means is connected to one and only one of the first and second connecting means, and is dimensioned such that the other of the second and first means is substantially freely movable with respect to the remainder of the fuse when the center portion fuses, that is, when a current overload is experienced. In this context, "substantially freely movable" means that the other of the second and first connecting means usually can fall freely by gravity from the remainder of the fuse under the weight of a conventional lead connected to it, but at worst can separate from the remainder of the fuse with no more than a nominal pull, a pull well below the force needed to seat the fuse in an associated fuse box or to connect the fuse to the first or second circuit elements.

Preferably, the first and second connecting means each comprise S-shaped, reverse C-shaped or L-shaped leaf spring clips adapted for connection to similarly shaped spring clips on associated circuit leads. One of such circuit leads can comprise a hot lead plate contained in a fuse box, to which a plurality of the fuses of the present invention can be connected.

In one preferred embodiment of the invention, the shield portion comprises a pair of heat resistant synthetic plastic plates fastened by an epoxy adhesive to the faces of one of the spring clips on the fuse element. Alternatively, the shield may be formed as a heat resistant, longitudinally compressible tube, slipped over one of the spring clips and the fuse element center portion, and trapped between both spring clips.

The present invention is also directed to a circuit construction incorporating such fuses, as well as an associated fuse box and set of connectable leads.

The present invention has numerous advantages over prior fuse constructions. The fuse assembly provides a dual visual and physical break of the circuit in which the fuse is placed. Preferably, the other of the second and first connecting means and its associated lead fall freely from the fuse assembly on breaching. Even if the other connecting means and the lead do not fall, the break in the fusible center portion is visible, and the connecting means and lead are easy to remove from the remaining portion of the fuse. The fuse of the present invention is necessarily safe because the fallen lead is remote from the fuse box during removal of the remainder of the fuse and during replacement of the fuse. Even if the connection to the fuse box is still hot, it is not possible to accidentally short across the lead because of its remote location. This saves the circuit from damage in case the power is inadvertantly not cut during replacement of the fuse.

The present invention is also advantageous because it is remarkably inexpensive to manufacture. Both the fuse element and the fuse box construction can be made by easy manufacturing steps, such as by extrusion of the plastic elements and rollforming or stamping of the metallic elements. Of course, the fuse of the present invention is easy to change, and the clips provide secure attachment of the fuses in the circuit without requiring any tools.

BRIEF DESCRIPTION OF THE DRAWING

A better understanding of the present invention will now be had upon reference to the following detailed description, when read in conjunction with the accompanying drawing, wherein like reference characters refer to like parts throughout the several views, and in which.

DETAILED DESCRIPTION OF THE PREFERRED EMBODIMENT OF THE PRESENT INVENTION

Figure 1:
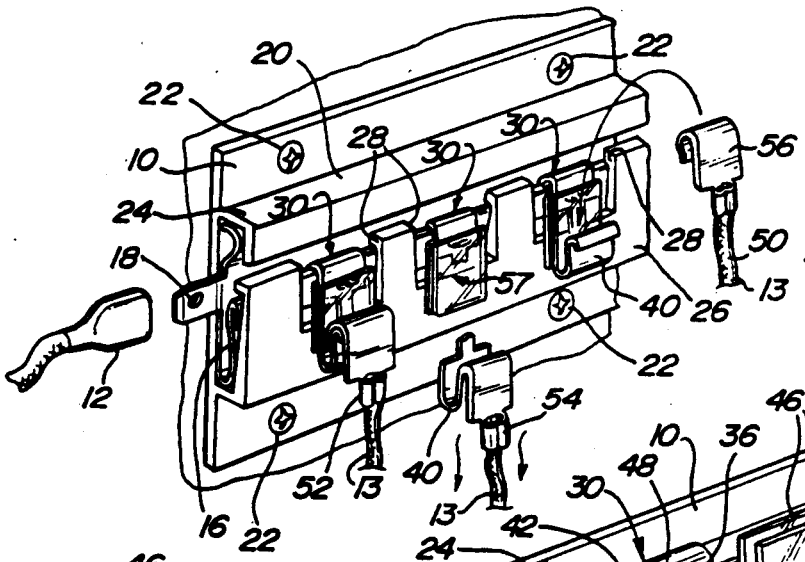
FIG. 1 is a perspective view of the preferred embodiment of the present invention.

With reference first to FIG. 1, a fuse holder 10 and a plurality of fuses 30 are thereshown for providing a fused connection between a first circuit element such as a common hot lead 12 and a second circuit element such as a plurality of utility leads 13. The utility leads 13 in turn provide current to various current using devices not shown, for example, power consuming accessories in an automobile. The fuse holder 10 comprises a laterally elongated conductive metal plate 14 contained in an extruded insulating plastic casing 20. The plate 14 includes a lateral tab 18 on one end for connection to the hot lead 12. The plate 14 also includes a spring clip 16 formed on its lower end. The plastic casing 20 includes a plurality of screw holes 22 for mounting the fuse holder 10 to a convenient surface, example, an interior body panel of an automobile.

The plastic casing 20 includes a lower cover portion 26 which extends over the face of the spring clip 16. The lower cover portion 26 can optionally include a plurality of spaced cutouts 28 permitting engagement of fuses 30 with the face of the spring clip 16. If the cutouts 28 are omitted, the fuses 30 make electrical contact with only the back of the spring clip 16. The plastic casing 20 also includes an upper cover portion 24 preventing the inadvertant contact of the utility leads 13 with the plate 14.

Figure 3:
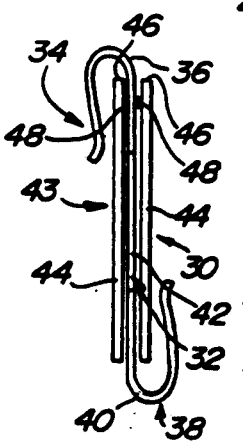
FIG. 3 is a cross-sectional view of a portion of the preferred embodiment of the present invention.
Figure 2:
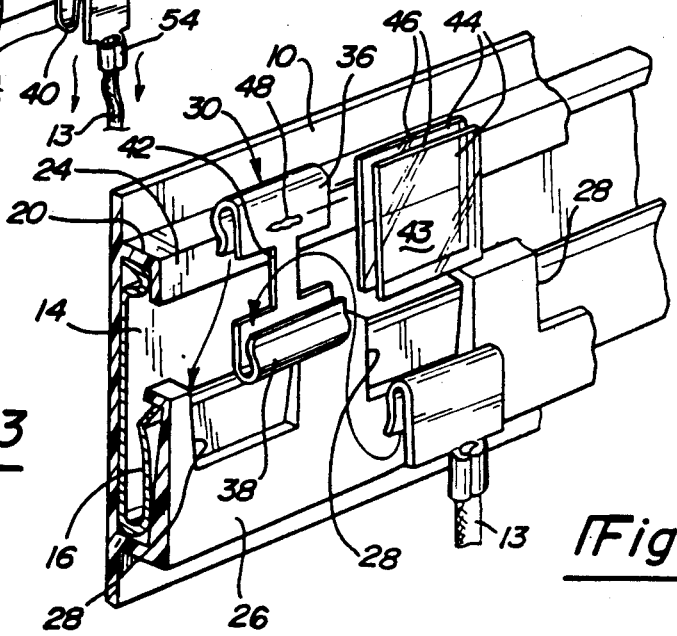
FIG. 2 is an exploded view of the preferred embodiment of the present invention.

With reference now to FIGS. 1, 2, and 3, the fuse 30 according to the present invention first comprises a conductive but resistive and centrally fusible element 32. The element 32 first comprises a first connecting means 34 for connecting the fuse 30 to the first circuit element, through engagement with the plate 14. Preferably, the first connecting means 34 comprises an upper spring clip 36 adapted for removable engagement with the spring clip 16. The element 32 also comprises a second connecting means 38 for connection of the fuse 30 to the second circuit elements, that is, to the utility leads 13. Preferably, the second connecting means 38 comprises a lower spring clip 40 engageable with conventional spring clips 56 included in the utility leads 13. The fuse element 32 also comprises a narrow fusible bridge 42 interconnecting the upper spring clip 36 and the lower spring clip 40.

The fuse element 32 is of a unitary and one piece construction, that is, the spring clip 36, the spring clip 40 and the narrow bridge 42 are all composed of the same fusible material. Materials which are useful for the purpose of fusing in order to break a circuit are well known to those in the art, and need not be described in detail here. The narrow bridge 42 is dimensioned in accordance with the well-known principles governing the dimensioning of fusible elements in other conventional fuses, such that the bridge 42 forms the narrowest portion of the fusible element 32 and is thus the location at which fusing will first occur upon the application of excessive current. It is preferred that the proportion of the length to the width of the bridge 42 be such that no sparking between the upper clip 36 and the lower clip 40 is encountered when the bridge 42 is fused and the clips 36 and 40 are spaced apart at least the same distance as they are initially.

The fuse 30 of the present invention also comprises a heat resistant and electrically non-conductive shield 43 extending laterally over the width of at least the bridge 42 and at least one and preferably both of the faces of the first connecting means 34. The shield 43, however, is affixed to one and only one of the first connecting means 34 and the second connecting means 38, for example, to only the spring clip 36. Preferably, the shield 43 comprises a pair of flat synthetic covers 44 composed of an insulating plastic transparent material. The covers 44 are each affixed at their upper ends 46 to the upper spring clip 36 by an adhesive layer, such as an epoxy adhesive 48.

As shown in FIG. 3, the covers 44 are spaced apart a distance sufficient to permit the lower spring clip 40 to be substantially freely movable with respect to the remainder of the fuse 30 upon fusing of the narrow bridge 42. The result of such movability can be observed in the use of the fuse 30 in conjunction with the fuse holder 10 and the utility leads 13. With particular reference to FIG. 1, the fuses 30 are affixed to the fuse holder 10 by slipping the upper spring clips 36 over the portions of the spring clips 16 exposed by the cutouts 28. One of the leads, for example, the lead 50, is shown being connected to its associated fuse 30 by slipping the spring clip 56 over the lower spring clip 40 of the fuse 30 in the direction indicated by the arrow. A utility lead 13 already connected to a fuse 30 in this fashion is shown as lead 52. Lead 54 exemplifies a lead which has pulled its associated spring clip 40 away from the fuse 30 when the bridge 42 has been fused by excessive current.

Preferably, the weight of the lead 54 and its associated lower spring clip 40 pull the lower spring clip 40 away from the fuse, thereby breaking the circuit in which lead 54 is contained. Therefore, "substantially freely movable" in this context means that the lower spring clip 40 can usually fall by gravity from the associated fuse 30 upon fusing of the bridge 42, but is at worst able to separate from the fuse 30 with no more than a nominal pull, for example, a pull or force well below the force needed to seat the fuse 30 in the fuse holder 10, or to connect the lead clip 56 to the lower spring clip 40.

Once the lead 54 has fallen away from the fuse holder 10, removal of the remainder 57 of the burned out fuse 30 is a simple matter. Most notably, although certainly not recommended, even if the fuse remainder 57 is removed from the fuse holder 10 without disconnecting or inactivating the hot lead 12, damage to the circuit in which the lead 54 is contained is affirmatively avoided because the lead 54 is physically separated from the fuse holder 10. A replacement fuse 30 can then be repositioned in the cutout 28, and the lead 13 reconnected to it, once the condition leading to fusing of the fuse 30 has been corrected.

Figure 5:
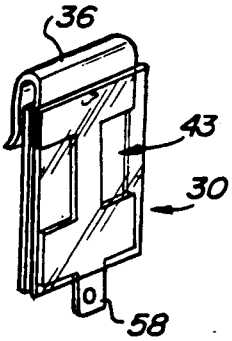
FIG. 5 is a perspective view of another preferred embodiment of the present invention.
Figure 6:
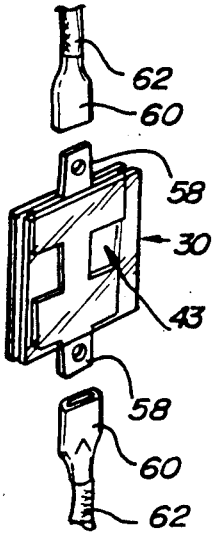
FIG. 6 is a perspective view of another preferred embodiment of the present invention.

Several modifications to the preferred embodiment of the present invention can be made without departing from the spirit of the invention. For example, as shown in FIG. 5 and 6, either or both of the first connecting means 34 and the second connecting means 38 can comprise a tang or flange 58, instead of the spring clips 36 and 40. An embodiment in which the lower spring clip 40 has been replaced with the tang 58 is shown in FIG. 5, while an embodiment in which both clips 36 and 40 have been replaced by tangs 58 is shown in FIG. 6. In either case, the tang or flange 58 is dimensioned and adapted to engage a slip-on clip 60 of conventional construction affixed to a utility lead 62.

Figure 4:
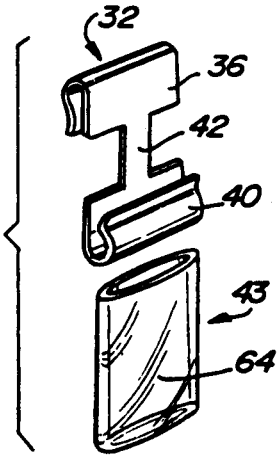
FIG. 4 is an exploded view of another preferred embodiment of the present invention.

Another preferred embodiment of the invention is shown in FIG. 4, in which the shield 43 comprises a longitudinally compressible tubular cover 64 which can be slid over one of the spring clips 36 or 40, and trapped between them, thereby covering the bridge 42. Like the covers 44, the tubular cover 64 is preferably composed of a transparent plastic insulating material, having sufficient heat resistance to withstand fusing of the bridge 42 without adherence of the second connecting means 38 to the cover 64.

It is also preferred that the shield 43, while generally sufficiently transparent to allow a visual determination of fusing of the bridge 42, can also be coded to represent the amperage that the fuse 30 can withstand without fusing of the bridge 42. The coding can be provided by a colored or numbered label affixed over the shield 43, in a location which does not obscure the bridge 42 from being readily visible. Preferably, however, the transparent plastic is tinted with a color representing the amperage of the fuse 30, corresponding to the colors conventionally employed for other fuses of similar amperage. Alternatively, the widths of the cutouts 28 and the shield 43 can be selected to correspond to various fuse amperages, widening as amperage rating increases, so that it would not be physically possible to place a higher amperage fuse in a circuit requiring a lower amperage limit.

While the shield 43 is preferably directly affixed to one of the first and second connecting means 34 and 38, all that is required in the fuse construction of the present invention is that the shield 43 be connected to or associated with a particular one of the connecting means 34 and 38 in one manner or another. For example, the shield 43 can be connected to either connecting means 34 or 38 by affixment to or being carried on the circuit lead 12 or 13 to which the connecting means 34 or 38 is connected. Alternatively, the shield 43 can be formed as a portion of the fuse holder 10, such as an extension of the plastic casing 20, which extends over the fusible center bridge 42 of the fuse element 32. In either embodiment it is still desirable that the shield 43 extends across the fusible center bridge 42 and remains associated with the particular connecting means 34 or 38 upon fusing of the bridge 42.

Again, the fuse construction of the present invention has several advantages over the prior fuse constructions. The fuse of the present invention provides a dual visual and physical break in the circuit. While it is preferred that the second connecting means 38 falls freely from the remainder of the fuse 30 upon breaching, even if it does not, the visible break plus the lack of resistance to removal when the associated lead is gently tugged provide a reliable indication of breaking of the circuit. The preferred fuse and circuit construction also possesses the advantage that the circuit lead is necessarily remote from the fuse holder when the fuse is removed and replaced, even if inadvertantly the current is not cut to the fuse holder during replacement of the fuse. The fuses of the present invention are of course easy to change, and the slip clip connections give secure connection without the need for any tools. Perhaps the greatest advantage of the present invention, however, is its inexpensive nature. The fuse with the present invention can be constructed by simple and inexpensive conventional manufacturing steps. For example, the plastic elements are readily subject to extrusion (the optional cutouts 28, if present, being formed after extrusion), while the fusible element 32 can be rollformed or stamped from an appropriate metal.

Having described my invention, however, many modifications thereto will become apparent to those skilled in the art to which it pertains, without deviation from the spirit of the invention, as defined by the scope of the appended claims.

I claim:

1. A fuse for use in providing a fusible connection between first and second circuit elements, comprising:

a fuse element comprising a fusible center portion, first means on one end of said center portion for connecting said element to said first circuit element, and second means on an end of said fusible center portion opposite said one end for connecting said element to said second circuit element; and a shield means extending laterally over the width of at least said center portion and a face of said first connecting means, connected to only one of said first and second connecting means, said shield means being dimensioned such that the other of said second and first connecting means is substantially freely moveable with respect to the remainder of said fuse upon fusing of said center portion.

2. The fuse according to claim 1, wherein said fusible center portion is substantially smaller in cross section than is either of said first and second connecting means.

3. The fuse according to claim 1, wherein at least one of said first and second connecting means comprises a spring clip.

4. The fuse according to claim 1, wherein said shield means comprises a pair of essentially rigid plastic plates each affixed to the same one of said first and second connecting means.

5. The fuse according to claim 1, wherein said shield means comprises a longitudinally compressible tubular cover.

6. The fuse according to claim 1, wherein said shield means is affixed to said one of said first and second connecting means by an epoxy adhesive.

7. The fuse according to claim 1, wherein said shield means is generally transparent but is tinted with a color corresponding to the amperage rating of said fuse.

8. The fuse according to claim 1, wherein said shield means is directly affixed to said one of said first and second connecting means.

9. A circuit construction comprising first and second circuit elements and a fuse providing a fusible connection between said first and second circuit elements, said fuse comprising:

a fuse element comprising a fusible center portion, first means on one end of said center portion for connecting said element to said first circuit element, and second means on an end of said fusible center portion opposite said one end for connecting said element to said second circuit element; and a shield means extending laterally over the width of at least said center portion and a face of said first connecting means, connected to only one of said first and second connecting means, said shield means being dimensioned such that the other of said second and first connecting means is substantially freely moveable with respect to the remainder of said fuse upon fusing of said center portion.

10. The circuit construction according to claim 9, wherein said first circuit element comprises a fuse holder to which said fuse is connected and a conductive lead connected to said fuse holder.

11. The circuit construction according to claim 9, wherein said first circuit element comprises a laterally elongated hot lead plate having a spring clip formed thereon for engagement with said fuse.

12. The circuit construction according to claim 11, wherein said fuse holder further comprises a plastic casing containing said plate, dimensioned to expose portions of said plate for connection to said fuses.

* * * * *